US005169418A

United States Patent [19]

Honda et al.

[11] Patent Number: 5,169,418

[45] Date of Patent: Dec. 8, 1992

[54] CLEAN ROOM ARRANGEMENT

[75] Inventors: Shigeo Honda; Hiroaki Abe, both of Narashino; Kazutomo Isono, Tokyo, all of Japan

[73] Assignee: Asahi Kogyosha Co., Ltd., Tokyo, Japan

[21] Appl. No.: 765,809

[22] Filed: Sep. 26, 1991

[30] Foreign Application Priority Data

Oct. 11, 1990 [JP] Japan ..... 2-270593

[51] Int. Cl.[5] ..... B01D 46/00; B01D 50/00

[52] U.S. Cl. ..... 55/268; 55/385.2; 454/187

[58] Field of Search ..... 55/385.2, 467, 268; 98/31.5, 31.6, 33.1, 34.5, 34.6

[56] References Cited

U.S. PATENT DOCUMENTS

| | | | |
|---|---|---|---|
| 2,193,460 | 3/1940 | Lavigne | 55/269 |
| 4,164,901 | 8/1979 | Everett | 55/385.2 X |
| 4,562,955 | 1/1986 | Holster et al. | 98/34.6 X |
| 4,651,553 | 3/1987 | Kunzel | 55/268 X |
| 4,667,580 | 5/1987 | Wetzel | 98/34.6 |
| 4,672,887 | 6/1987 | Sproul | 98/31.6 |
| 4,693,175 | 9/1987 | Hashimoto | 98/31.6 |
| 4,694,736 | 9/1987 | Yamagata et al. | 98/31.6 |
| 4,775,001 | 10/1988 | Ward et al. | 98/31.6 X |

*Primary Examiner*—Charles Hart

*Attorney, Agent, or Firm*—Dykema Gossett

[57] ABSTRACT

A clean room arrangement comprises a clean room having an upper portion and a lower portion. Clean air is introduced into the upper portion of the clean room, flows downward and expelled from the lower portion of the clean room. An air recirculation passage is connected to the clean room such that the lower portion of the clean room is communicated with the upper portion of the clean room. A heat source is provided in the air recirculation passage to generate an ascending flow of air in the air recirculation passage so that the air descends in the clean room due to natural convection.

18 Claims, 4 Drawing Sheets

CLEAN ROOM ARRANGEMENT

TECHNICAL FIELD

The present invention relates to a clean room arrangement for feeding clean air to a clean room and more particularly to a clean room arrangement for circulating clean air by natural convection.

BACKGROUND ART

Generally, clean room arrangements have a clean room, an air feed chamber formed in an upper portion of the clean room and a recirculation chamber formed in a lower portion of the clean room. The air feed chamber is provided with a filter and feeds clean air into the clean room through the filter. The recirculation chamber is provided with a grating and sucks the clean air through the grating. Therefore, the clean air introduced into the clean room from the air feed chamber via the filter goes down and enters the recirculation chamber. Then, the clean air is recirculated to the air feed chamber. On the way to the air feed chamber, external air for the ventilation is added to the circulating clean air if necessary, and such a combination is recirculated into the clean room.

Various types of clean room arrangement are proposed. FIG. 5 of the accompanying drawings shows one of such arrangements. An air conditioner a is placed outside a clean room f and used to recirculate the clean air. A filter e extends in an upper portion of a clean room arrangement 1 and defines an air feed chamber d above the filter e. A clean room f is defined below the filter e. In other words, the filter e serves as a ceiling of the clean room f. A grating g extends in a lower portion of the clean room arrangement 1 and is used as a floor of the clean room f. A recirculation chamber h is defined below the grating h whereas the clean room f is defined above the grating h. An outlet of the recirculation chamber h is connected to an inlet of the air conditioner a by a recirculation duct i. An outlet of the air conditioner a is connected to the air feed chamber d by an air feed duct c. A blower b of the air conditioner a forces the air to flow into the air feed chamber d through the air feed duct c and the air is introduced into the clean room f after it is filtered by the filter e. The clean air entering the clean room f descends into the recirculation or air recovery chamber h, as indicated by the arrows in the drawing. The clean air flows through the grating g as it enters the recirculation chamber h. Then, the clean air returns to the air conditioner a through the recirculation duct i.

FIG. 6 shows another clean air arrangement. The air conditioner a is joined with the clean room f. The clean air from the blower b directly enters the air feed chamber d from the outlet of the air conditioner a. The outlet of the air conditioner a communicates with the upper portion of the upper portion of the clean room f. Likewise, the clean air from the recirculation chamber h directly flows into the inlet of the air conditioner a. The lower portion of the clean room communicates with the inlet of the air conditioner a.

FIG. 7 illustrates an arrangement which has a blower j equipped with filters. The clean room f is defined in the clean room arrangement 1 with the recirculation space k being formed around the clean room f. The clean air is directly introduced into the clean room f by the filter-provided blower j and then expelled to the recirculation chamber h from the clean room f via the grating g. The clean air then flows upward in the recirculation chamber h and returns to the air feed chamber d.

These conventional arrangements have following problems:

If an air flow rate of the blower is raised in order to obtain high cleanliness in the clean room f, the pressure loss across the filter becomes large and the power for the blower becomes large. In addition, the recirculation of the clean air by the blower causes a non-homogeneous pressure profile in the recirculation system which in turn causes a drift current in the clean room. On the other hand, if the air flow rate of the blower is lowered and high cleanliness of the clean room is attempted, a turbulence is generated in the clean room and an ascending current is locally produced in the clean room. Therefore, high cleanliness cannot be expected.

SUMMARY OF THE INVENTION

One object of the present invention is to provide a clean room arrangement which can provide a recirculating flow of clean air without blowers.

According to one aspect of the present invention, there is provided a clean room arrangement which comprises a clean room, an air recirculation passage connected to lower and upper portions of the clean room for recirculating air from the lower portion of the clean room to the upper portion of the clean room and a warm heat source for generating an ascending current in the air recirculation passage.

According to another aspect of the present invention, there is provided a clean room arrangement which comprises a clean room, an air feed chamber formed in an upper portion of the clean room, a recirculation chamber formed in a lower portion of the clean room, an air recirculation passage connecting the air feed chamber with the recirculation chamber, a warm heat source for producing an ascending current in the air recirculation passage and a cold heat source mounted or placed in the air feed chamber or the recirculation chamber for forming a more stable flow of air in the clean room.

Since the air recirculation passage is provided with the warm heat source, the air in the air recirculation passage is heated and the ascending current of air flowing into the air feed chamber is generated. The air introduced from the air feed chamber descends therein due a temperature difference, i.e., the air goes down by natural convection. If the air feed chamber or the recirculation chamber is provided with a cold heat source, a more stable ascending current is produced and maintained in the air recirculation passage and as well as in the clean room.

DESCRIPTION OF THE PREFERRED EMBODIMENTS

Preferred embodiments of the present invention will be described with reference to the accompanying drawings. In the following detailed description, the same numerals are assigned to like elements in different figures.

Figure 1:
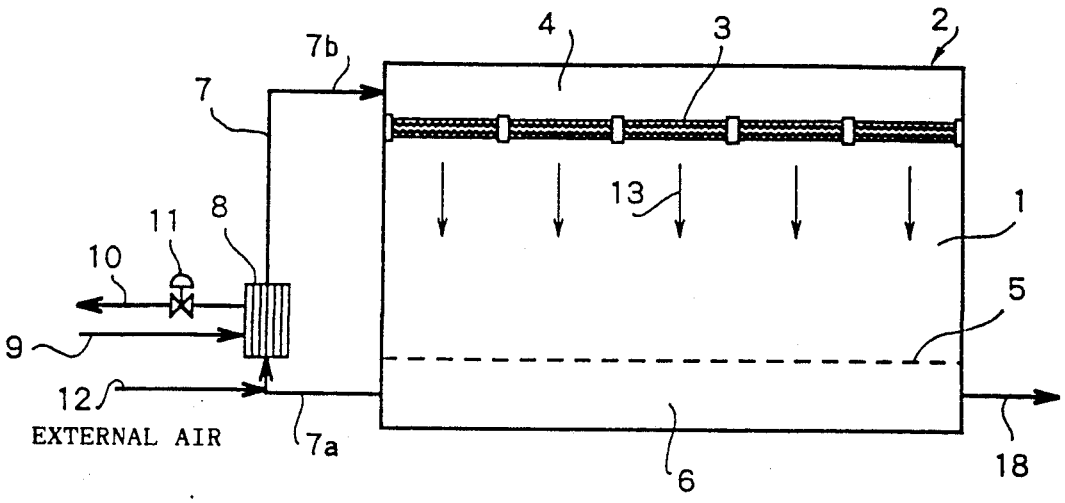
FIG. 1 shows a sectional view of a clean room arrangement according to a first embodiment of the present invention.

Referring to FIG. 1, numeral 1 designates a clean room formed in a factory or a laboratory and a clean room arrangement is generally indicated by the numeral 2. An air feed chamber 4 is formed in an upper portion of the clean room 1. A filter 3 which extends in the upper portion of the clean room 1 generally in a horizontal direction defines the air feed chamber 4. A recirculation chamber 6 is formed in a lower portion of the clean room 1. A grating 5 which extends in the lower portion of the clean room 1 defines the recirculation chamber 6.

The air chamber 4 and the recirculation chamber 6 are connected with each other by an air recirculation passage 7. The air recirculation passage 7 is provided with a heat exchanger 8 (warm heat source). An inlet pipe 9 is connected with the heat exchanger 8 such that a heating medium of high temperature such as warm water and steam may be fed into the heat exchanger 8. An outlet pipe 10 which is equipped with a heating mediuum flow rate control valve 11 is also connected with the heat exchanger 8.

An external air duct 12 is connected to a circulation duct *7a* of the circulation passage 7 connecting the circulation chamber 6 with the heat exchanger 8 such that external air can merge with the recirculated air. An exhaust duct 18 is connected to the circulation chamber 6 such that the air in the chamber 6 can be expelled out of the clean room arrangement. The exhaust duct 18 is provided with a damper (not shown) for adjusting an amount of exhaust. Preferably, an air feed duct *7b* connecting the heat exchanger 8 to the air feed chamber 4 is covered with a heat insulating material.

The air in the heat exchanger 8 is heated as the heating medium is supplied into the heat exchanger 8 through the feed pipe 9. Then, the heated air ascends in the feed duct *7a* of the air recirculation passage 7 due to its buoyancy and reaches the air feeding chamber 4. At the same time, the air in the recirculation duct *7b* moves up toward the heat exchanger 8. Accordingly, air circulation occurs in the clean room arrangement. Specifically, the hot air flowing into the air feed chamber 4 is clarified to the clean air by the filter 3 and then enters the clean room 1. Such clean air flows downward in the clean room 1 as indicated by the arrows 13. Then, the clean air is recovered by the circulation chamber 6 via the grating 5 and flows back into the heat exchanger 8 through the circulation duct *7a*.

The flow rate of the recirculated air can be adjusted by the flow rate control valve 9. Specifically, the recirculated air flow rate is adjusted by controlling a flow rate of the heating medium such as hot water flowing into the heat exchanger 8, i.e., by controlling the amount of heat exchanged between the air and the heating medium.

The descending flow of air occurs in the clean room 1 due to the natural convection of the air caused by the buoyancy of the air. Thus, a stable descending flow of air is assured.

Figure 2:
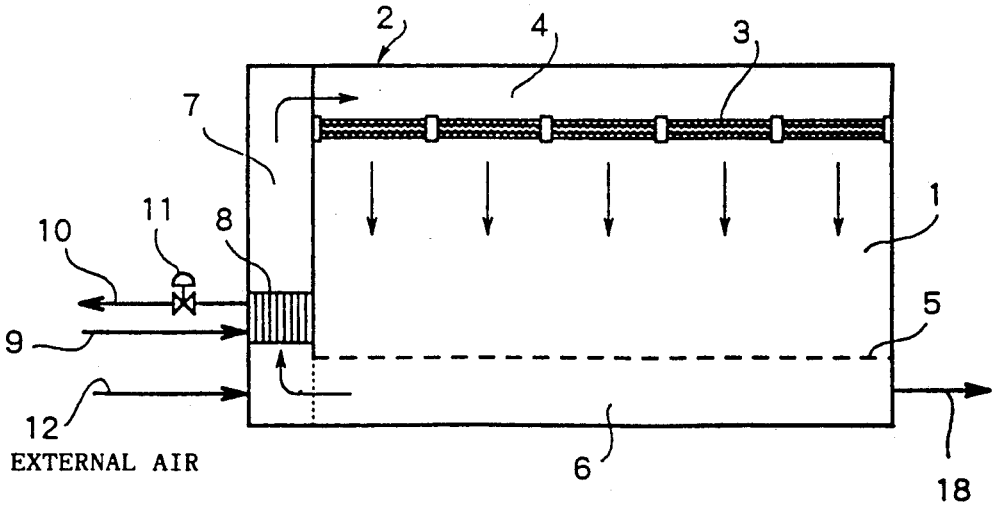
FIG. 2 shows a sectional view of a second embodiment of the present invention.

FIG. 2 shows another embodiment of the present invention. As compared with the clean room arrangement 2 of FIG. 1 in which the externally provided air circulation passage 7 is connected to the clean room 1 by the ducts *7a* and *7b*, the arrangement 2 of FIG. 2 has an integrated recirculation passage 7. The passage 7 extends vertically next to the clean room 1 with an upper outlet of the passage 7 being directly communciated with the upper portion of the air feed chamber 4 and a lower inlet of the passage 7 being directly communicated with the lower portion of the air circulation chamber 6.

In FIG. 2, a section of the air circulation passage 7 can be designed arbitrarily. In FIG. 1, generally standard pipes are employed as the pipes *7a* and *7b*. This means that a designer of the clean room arrangement can choose a pipe from ready-made ones. Further, the heat transfer area of the heat exchanger provided in the air passage 7 can be determined arbitrarily according to the arrangement of FIG. 1. Consequently, a more precise natural convection is realized and a more precise air flow rate control becomes possible.

Figure 3:
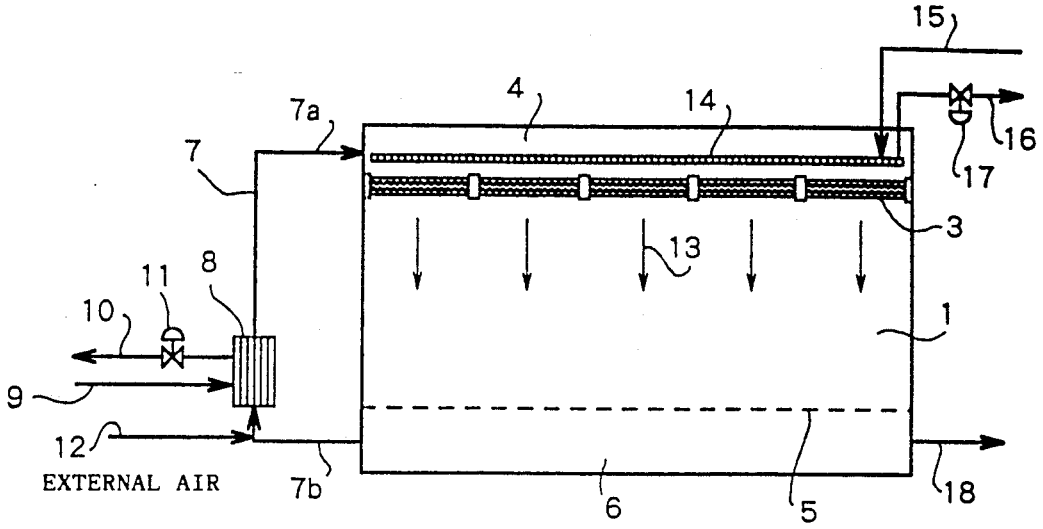
FIG. 3 illustrates a sectional view of a third embodiment according to the present invention.
Figure 4:
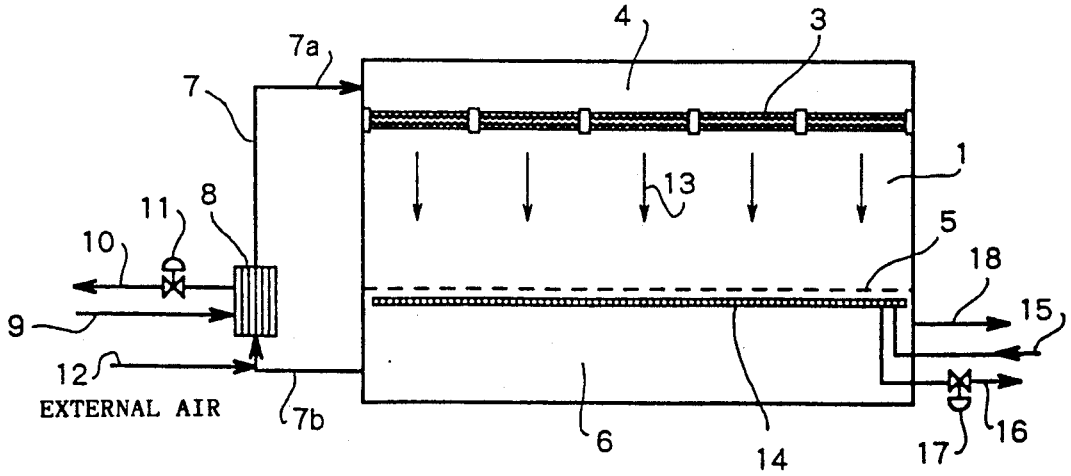
FIG. 4 is a section of a fourth embodiment according to the present invention.
Figure 5:
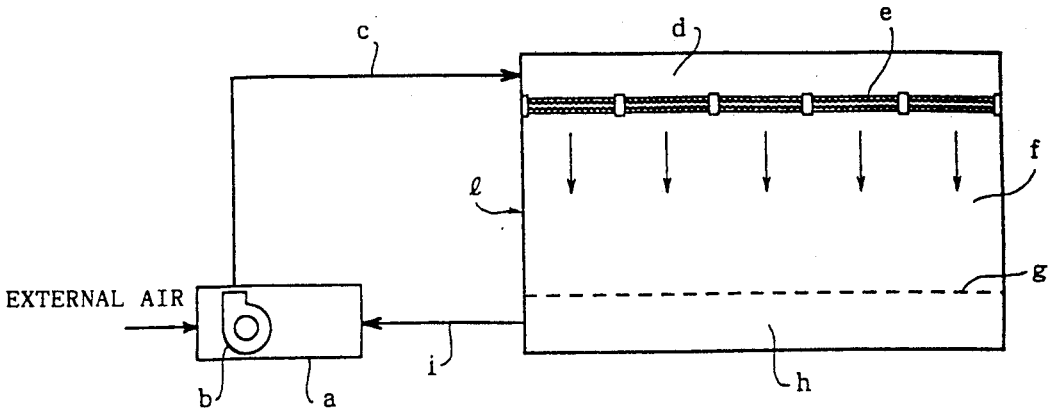
FIGS. 5 to 7 respectively show sectional views of conventional clean room arrangements.
Figure 6:
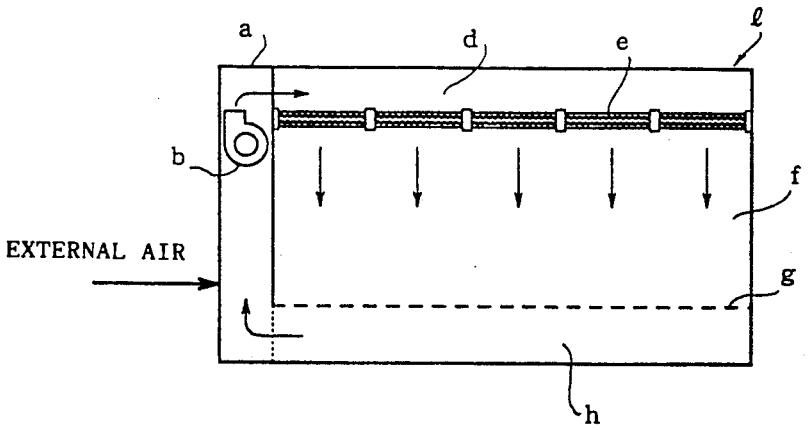
Figure 7:
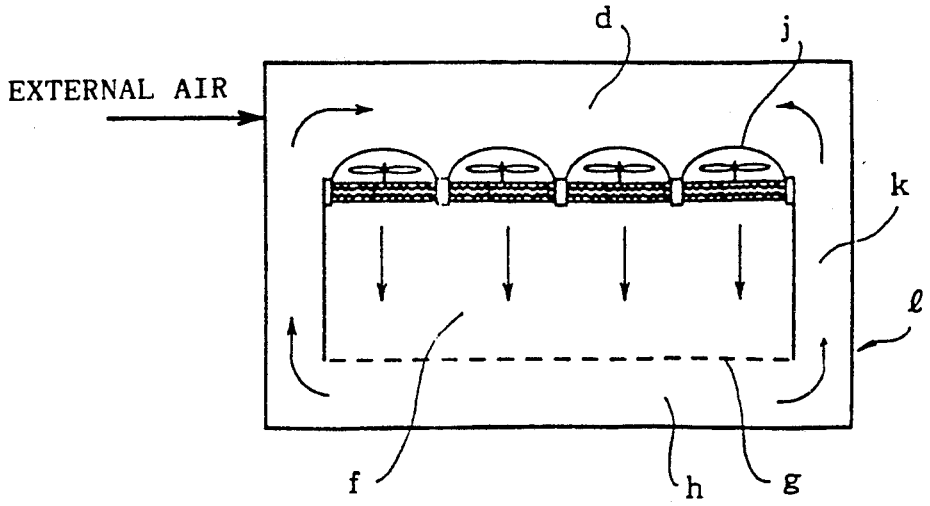

FIGS. 3 and 4 illustrate other embodiments of the present invention, respectively.

Arrangements of these figures are fundamentally similar to that of FIG. 1. A major difference is a cooling heat exchanger 14 (cold heat source). In FIG. 3, the cooling heat exchanger 14 is provided in the air feeding chamber 4 and extends just above and along the filter 3. In FIG. 4, the cooling heat exchanger 14 is provided in the air circulation chamber 6 and extends just below and along the grating 5. A cooling medium such as cold water is supplied into the cooling heat exchanger 14 through a feed pipe 15 and discharged from the heat exchanger 14 through a discharge pipe 16. The discharge pipe 16 is provided with a flow rate control valve 17 to adjust the flow rate of the cooling medium.

In the embodiments of FIGS. 1 and 2, the flow rate of the recirculated air is generally determined by an amount of heat exchanged in the heat exchanger 8, the temperature drop of the air due to heat radiation to outside from the clean room 2 and the amount of ventilation with the external air. However, this flow rate is easily affected by for example the temperature of the external air. According to the arrangements of FIGS. 3 and 4, on the other hand, since the air in the air feed chamber 4 or the air circulation chamber 6 is cooled by the heat exchanger 14 in order to effectively cause the natural convection due to the buoyancy, the temperature of the air flowing into the other heat exchanger 8 can be controlled more precisely and therefore the circulation of the air due to the buoyancy occurs more effectively. In the case of FIG. 3, the hot air entering the air feed chamber 4 is cooled therein before it is introduced into the clean room 1. In the case of FIG. 4, the hot air entering the air feed chamber 4 is introduced into the clean room 1 as the hot clean air and cooled in the recirculation chamber 6.

It should be noted that the present invention is not limited to the illustrated arrangements. For example, the cooling heat exchanger 14 may be located in both the air feed chamber 4 and the air recirculation chamber 6. The flow rate control valve 17 may be mounted on the feed pipe 15 instead of the discharge pipe 16. Although the heat exchanger 8 is used as the hot heat source, an electric heater may be used instead thereof.

As described above, the present invention has following advantages:

(1) Since blowers are not used, no turbulence occurs in the descending air in the clean room;

(2) Further, as compared with the case where the air circulation is caused by the blowers, less energy is consumed in the circulation of the air; and (3) A stable descending flow of air is ensured in the clean room even if a pressure profile in the air circulation system is not controlled.

We claim:

1. A clean room arrangement, comprising:

a clean room having an upper portion and a lower portion, clean air being introduced into the clean room from the upper portion thereof, flowing downward and expelled from the clean room from the lower portion thereof;

an air recirculation passage for recirculating the air of the lower portion of the clean room into the upper portion of the clean room; and convection air current generating means for generating an ascending flow of air current in the air recirculating passage, wherein the entire flow of recirculating air in the air recirculation passage is solely due to natural convection.

2. The arrangement of claim 1, wherein the clean room includes a filter provided in the upper portion of the clean room and a grating provided in the lower portion of the clean room, and the filter serves as a ceiling of the clean room and the grating serves as a floor of the clean room.

3. The arrangement of claim 2, wherein an air feed chamber is defined above the filter in the upper portion of the clean room, a air recirculation chamber is defined below the grating in the lower portion of the clean room, the air recirculation passage includes a duct connecting the air feed chamber with the air recirculation chamber and the warm heat source includes a heat exchanger mounted on the duct.

4. The arrangement of claim 3, wherein a warm water feed device is connected to the heat exchanger.

5. The arrangement of claim 4, wherein the warm water feed device includes a flow rate control valve for adjusting the flow rate of a heating medium introduced into the heat exchanger in order to change the speed of the ascending air in the duct.

6. The arrangement of claim 5, wherein an external air feed line is connected to the duct upstream of the heat exchanger such that external air may be added to the recirculating air.

7. The arrangment of claim 1, wherein the convection air current generating means includes a heat source.

8. A clean room arrangement, comprising:

a clean room having an upper portion and a lower portion, air being introduced into the clean room from the upper portion thereof, flowing downward and expelled from the clean room from the lower portion thereof;

a filter mounted in the upper portion of the clean room, air above the filter being introduced into the clean room after it is cleansed by the filter, the filter serving as a ceiling of the clean room;

a grating mounted in the lower portion of the clean room, the air in the clean room flowing into the lower portion through the grating, the grating serving as a floor of the clean room;

an air recirculation passage formed next to the clean room for recirculating the air of the lower portion of the clean room into the upper portion of the clean room; and convection air current generating means located in the air recirculation passage for generating an ascending flow of air current in the air recirculation passage, wherein the entire flow of recirculating air in the air recirculation passage is solely due to natural convection.

9. The arrangement of claim 8, wherein the heat source includes a heat exchanger, the heat exchanger is provided with a heating medium feeding device for supplying a heating medium into the heat exchanger and the heating medium feeding device has means for controlling a flow rate of the heating medium.

10. The arrangement of claim 8, wherein the convection air current generating means includes a heat source.

11. A clean room arrangement, comprising:

a clean room having an upper portion and a lower portion, air being introduced into the clean room from the upper portion thereof, flowing downward and expelled from the clean room from the lower portion thereof;

a filter mounted in the upper portion of the clean room, air above the filter being introduced into the clean room after it is cleansed by the filter, the filter serving as a ceiling of the clean room;

a grating mounted in the lower portion of the clean room, the air in the clean room flowing into the lower portion through the grating, the grating serving as a floor of the clean room;

an air recirculation passage for connecting the lower portion of the clean room with the upper portion of the clean room;

convection air current generating means located in the air recirculation passage for generating an ascending flow of air current in the air recirculation passage, wherein the entire flow of recirculating air in the air recirculation passage is solely due to natural convection; and a cooler heat source located in the air feed changer for assisting a formation of descending flow of air introduced into the clean room from the air feed chamber.

12. The arrangement of claim 10, wherein the warm heat source includes a heat exchanger, the heat exchanger is provided with a heating medium feeding device for supplying a heating medium into the heat exchanger and the heating medium feeding device has means for controlling a flow rate of the heating medium.

13. The arrangement of claim 10, wherein the cooler heat source includes a cooling heat exchanger extending along the filter, the cooling heat exchanger is provided with a cooling medium feeding device for supplying a cooling medium into the heat exchanger and the cooling medium feeding device has means for controlling the flow rate of the cooling medium.

14. The arrangement of claim 11, wherein the convection current generating means includes a heat source.

15. A clean room arrangement, comprising:

a clean room having an upper portion and a lower portion, air being introduced into the clean room from the upper portion thereof, flowing downward and expelled from the clean room from the lower portion thereof;

a filter mounted in the upper portion of the clean room, air above the filter being introduced into the clean room after it is cleansed by the filter, the filter serving as a ceiling of the clean room;

a grating mounted in the lower portion of the clean room, the air in the clean room flowing into the lower portion through the grating, the grating serving as a floor of the clean room;

an air recirculation passage for connecting the lower portion of the clean room with the upper portion of the clean room;

convection air current generating means located in the air recirculation passage for generating an ascending flow of air current in the air recirculation passage, wherein the entire flow of recirculating air in the air recirculation passage is solely due to natural convection; and a cooler heat source located in the air feed changer for assisting a formation of descending flow of air introduced into the clean room from the air feed chamber.

16. The arrangement of claim 15, wherein the warm heat source includes a heat exchanger, the heat exchanger is provided with a heating medium feeding device for supplying a heating medium into the heat exchanger and the heating medium feeding device has means for controlling a flow rate of the heating medium.

17. The arrangement of claim 16, wherein the cooler heat source includes a cooling heat exchanger extending along the filter, the cooling heat exchanger is provided with a cooling medium feeding device for supplying a cooling medium into the cooling heat exchanger and the cooling medium feeding device has means for controlling the flow rate of the cooling medium.

18. The arrangement of claim 15, wherein the convection air current generating means includes a warm heat source.

* * * * *